United States Patent [19]

Ona et al.

[11] Patent Number: 4,784,665

[45] Date of Patent: Nov. 15, 1988

[54] AGENT FOR THE TREATMENT OF FIBERS

[75] Inventors: Isao Ona; Masaru Ozaki; Osamu Tanaka, all of Chiba Prefecture, Japan

[73] Assignee: Toray Silicone Co., Ltd., Tokyo, Japan

[21] Appl. No.: 69,150

[22] Filed: Jul. 2, 1987

[30] Foreign Application Priority Data

Jul. 24, 1986 [JP] Japan ..... 61-174341

[51] Int. Cl.[4] ..... D06M 13/00

[52] U.S. Cl. ..... 8/115.6; 106/287.14; 106/2; 252/312

[58] Field of Search ..... 8/115.6; 106/287.15, 106/287.14, 287.16, 287.12, 2; 252/312

[56] References Cited

U.S. PATENT DOCUMENTS 4,620,878 11/1986 Gee ..... 106/287.15

*Primary Examiner*—Paul Lieberman
*Assistant Examiner*—John F. McNally
*Attorney, Agent, or Firm*—Robert L. McKellar

[57] ABSTRACT

The fiber treatment agent of this invention has as its major silicone component an organopolysiloxane microemulsion which is produced by the emulsion polymerization of an organopolysiloxane, which has an average particle size of ≦0.15 micrometers, and for which the extracted organopolysiloxane has a viscosity of at least 100 centistokes at 25° C. As a consequence, the fiber treatment agent of this invention characteristically has an excellent mechanical stability, dilution stability and blending stability, and will not cause the appearance of oil spots on the treated fiber.

4 Claims, No Drawings

AGENT FOR THE TREATMENT OF FIBERS

The present invention relates to a fiber treatment agent whose major silicone component is an organopolysiloxane microemulsion. More specifically, the present invention relates to a fiber treatment agent whose major silicone component is an organopolysiloxane microemulsion which is produced by emulsion polymerization.

BACKGROUND OF THE INVENTION

In order to impart softness, smoothness, crease resistance, elongation recovery and water repellency to fibrous materials of, natural fibers such as cotton, flax, silk, wool, angora, and mohair; regenerated fibers such as rayon and bemberg; semisynthetic fibers such as acetate; synthetic fibers such as polyester, polyamide, polyacrylonitrile, polyvinyl chloride, vinylon, polyethylene, polypropylene, and Spandex®; and inorganic fibers such as glass fiber, carbon fiber and silicon carbide fiber, emulsions are used having an average particle size of 0.3 micrometers, these microemulsions are obtained by the emulsification of organopolysiloxanes using an emulsifying device such as a homogenizer, colloid mill, line mixer or propeller mixer wherein one or more anionic, cationic, nonionic or amphoteric surfactants are used. The use is also known of emulsions having an average particle size of 0.3 micrometers which are obtained by the emulsion polymerization of dimethylpolysiloxane cyclics as shown in Japanese Patent Publication No. 44-20116.

Emulsions produced by the above methods, with their average particle size of 0.3 micrometers, have unsatisfactory stability in fiber treatments, they also have an unsatisfactory stability with regard to dilution dilution with water, and an unsatisfactory stability when used in combination with various additives (blending stability). As a consequence, these emulsions undergo de-emulsification, creating serious problems such as the organopolysiloxane floating on the treatment bath and appearing as drops of oil on the fibrous material (oil spots).

The object of the present invention is to eliminate the above problems by providing a fiber treatment agent which, having as its main silicone component, an organopolysiloxane microemulsion produced by emulsion polymerization which has excellent mechanical, dilution, and blending stabilities on the part of the emulsion, and which does not produce oil spots.

THE INVENTION

The aforesaid objectives can be accomplished by means of a fiber treatment agent whose major silicone component is an organopoly siloxane microemulsion, wherein said microemulsion is obtained by the emulsion polymerization of an organopolysiloxane, the average particle size in said microemulsion being $\leqq 0.15$ micrometers, and the viscosity of the extracted organopolysiloxane is at least 100 centistokes at 25° C.

The organopolysiloxane microemulsion operative in the present invention is produced by the emulsion polymerization of an organopolysiloxane having a low degree of polymerization, and the average particle size in this emulsion after emulsion polymerization must be $\leqq 0.15$ micrometers and preferably is $\leqq 0.12$ micrometers. The mechanical, dilution and blending stabilities are reduced when the average particle size exceeds 0.15 micrometers, and oil spots will then be generated in any extended treatment of fibrous material. The viscosity of the organopolysiloxane extracted after emulsion polymerization should be at least 100 centistokes, preferably at least 1,000 centistokes, and more preferably 10,000 to 300,000 centistokes at 25° C. When the viscosity of this organopolysiloxane is less than 100 centistokes, softness and smoothness cannot be imparted to the fibrous material.

This emulsion can be produced by an emulsion polymerization in which a crude emulsion, consisting of an organopolysiloxane having a low degree of polymerization, plus surfactant and water, is gradually dripped into an aqueous solution containing a catalytic quantity of a polymerization catalyst only or a catalytic quantity of a polymerization catalyst and an emulsifying agent.

Cyclic organopolysiloxanes with the following formula

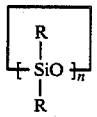

is a typical example of organopolysiloxane used as the starting material in the crude emulsion. In this formula, R is a monovalent hydrocarbon group, and it is exemplified by alkyl groups such as methyl, ethyl, propyl, and butyl; substituted alkyl groups such as 2-phenylethyl, 2-phenylpropyl, and 3,3,3-trifluoropropyl; alkenyl groups such as vinyl and propenyl; aryl groups such as phenyl and tolyl; and substituted aryl groups. The groups R in the molecule may be the same or different, and n is an integer having a value of 3 to 10. Said cyclic organopolysiloxane may be the single species, or may be a mixture of two or more species. In addition to these cyclic organopolysiloxanes, the addition of small quantities of hydroxylterminated diorganopolysiloxane or hydrolyzable group-containing silane, for example, N-(2-aminoethyl)-3-aminopropyltrimethoxysilane, trimethoxyvinylsilane or gamma-glycidoxypropyltrimethoxysilane is allowed. Also, hexaorganodisiloxane end blockers can be added to regulate the viscosity.

A surfactant is necessary in order to convert said organopolysiloxane into the crude emulsion, and this includes the anionic, cationic, and nonionic surfactants.

Examples of anionic surfactants are alkylbenzenesul fonic acids such as hexylbenzenesulfonic acid, octylbenzenesul fonic acid, decylbenzenesulfonic acid, dodecylbenzenesulfonic acid, cetylbenzenesulfonic acid, and myristylbenzensulfonic acid; the sulfate esters of polyoxyethylene monoalkyl ethers, for example, $CH_3(CH_2)_6CH_2O(C_2H_4O)_2SO_3H$, $CH_3(CH_2)_8CH_2O(C_2H_4O)_8SO_3H$, $CH_3(CH_2)_{19}CH_2O(C_2H_4O)_4SO_3H$, and $CH_3(CH_2)_8CH_2C_6H_4O(C_2H_4O)_2SO_3H$; and alkylnaphthylsulfonic acids.

Examples of cationic surfactants are quaternary ammonium hydroxides such as octyltrimethylammonium hydroxide, dodecyltrimethylammonium hydroxide, hexadecyltrimethylammonium hydroxide, octyldimethylbenzylammonium hydroxide, decyldimethyl benzylammonium hydroxide, didodecyldimethylammonium hydroxide, dioctadecyldimethylammonium hydroxide, beef tallow trimethylammon ium hydroxide, and coco trimethylammonium hydroxide; and their salts.

Examples of nonionic surfactants are polyoxyalkylene alkyl ethers, polyoxyalkylene alkylphenol ethers, polyoxyalkylene alkyl esters, polyoxyalkylene sorbitan alkyl esters, polyethylene glycol, polypropylene glycol, and diethylene glycol.

With the exception of the combinaton of anionic surfactant plus cationic surfactant, the surfactant may be used as the single species or as the combination of two or more species. In concrete terms, it is permissible to use a single species of anionic surfactant, or the combination of two or more species of anionic surfactants, or a single species of nonionic surfactant, or the combination of two or more species of nonionic surfactants, or a single species of cationic surfactant, or the combination of two or more species of cationic surfactants, or the combination of two or more species respectively selected from anionic and nonionic surfactants, or the combination of two or more species respectively selected from cationic and nonionic surfactants.

The surfactant is used in the crude emulsion in a quantity which provides for the formation of an emulsion, and this will vary with the type of surfactant. As a consequence, the quantity is not specifically restricted, but is preferably 2 to 50 wt %.

Water is used in the crude emulsion preferably in a quantity which gives an organopolysiloxane concentration of 10 to 60 wt %.

The crude emulsion is prepared by mixing the above organopolysiloxane, surfactant, and water to homogeneity, and passing this mixture through an emulsifying device such as a homogenizer, colloid mill, or line mixer.

Microemulsions operative in the present invention are obtained by an emulsion polymerization in which said crude emulsion is gradually dripped into a separately prepared aqueous solution containing a catalytic quantity of a polymerization catalyst only or a catalytic quantity of a polymerization catalyst and surfactant.

Said polymerization catalyst includes anionic catalysts and cationic catalysts. The anionic catalysts are exemplified by mineral acids such as hydrochloric acid and sulfuric acid, as well as by the alkylbenzenesulfonic acids, sulfate esters of polyoxy ethylene monoalkyl ethers, and alkylnaphthylsulfonic acids given above as examples of surfactants. The cationic catalysts are exemplified by alkali metal hydroxides, for example, potassium hydroxide and sodium hydroxide, as well as by the quaternary ammonium hydroxides and their salts given above as examples of surfactants.

The surfactant to be used in this polymerization corresponds to those given as examples of the surfactant to be used for the crude emulsion. Accordingly, when an alkylbenzene sulfonic acid, sulfate ester of polyoxyethylene monoalkyl ether, alkylnaphthylsulfonic acid or quaternary ammonium hydroxide or salt thereof is used as the surfactant, it can also function as the polymerization catalyst. From the standpoint of the ionic character of the emulsion, when an anionic surfactant is used for the crude emulsion, an anionic catalyst should be used to produce the microemulsion, and the surfactant should be an anionic and/or nonionic surfactant. On the other hand, when a cationic surfactant is used in the crude emulsion, a cationic catalyst should be used to produce the microemulsion, and the surfactant should be a cationic surfactant and/or nonionic surfactant. When a nonionic surfactant is used in the crude emulsion, an anionic or cationic catalyst may be used in microemulsion production: an anionic surfactant and/or nonionic surfactant should be used with an anionic catalyst, while a cationic surfactant and/or nonionic surfactant should be used with a cationic catalyst.

The surfactant in the aqueous solution of catalyst and surfactant is to be used at preferably 5 to 50 weight parts and more preferably 25 to 45 weight parts per 100 weight parts organopolysiloxane in the crude emulsion. The catalyst is to be used at 0.2 to 2.0 weight parts and preferably 0.5 to 1.0 weight part per 100 weight parts organopolysiloxane in the crude emulsion.

The temperature of the aqueous catalyst solution is preferably 40° to 95° C. when the crude emulsion is added dropwise. The rate of dropwise addition will vary with the type and concentration of the catalyst and with the temperature of the aqueous catalyst solution. Dropwise addition may be rapid when the catalyst concentration is high or when the temperature of the aqueous catalyst solution is high, but dropwise addition is preferably conducted over 30 minutes to obtain emulsions with smaller particle sizes. After dropwise addition, emulsion polymerization is conducted at 0° to 90° C. until the specified viscosity is achieved to afford a microemulsion having an average particle size 0.15 micrometers. After emulsion polymerization, the catalyst is preferably neutralized with alkali in the case of an anionic polymerization catalyst, or with acid in the case of a cationic polymerization catalyst. Furthermore, while the organopolysiloxane concentration at the time of emulsion polymerization is not specifically restricted, it is preferably 5 to 50 wt %.

A more detailed account of the preparation of the microemulsions useful of this invention can be found in U.S. patent applications Ser. No. 809,090, filed Dec. 12, 1985 in the name of Daniel Graiver and Osamu Tanaka and entitled "Methods for Making Polydiorganosiloxane Microemulsions", which microemulsions and their preparation are incorporated herein by reference.

The fiber treatment agent of the present invention can contain additional water; various resin finishing agents such as glyoxal resins, melamine resins, urea resins, polyester resins, or acrylic resins; organohydrogenpolysiloxane; organoalkoxysilane; additional surfactant; preservatives; colorants, etc.

Fibrous material can be treated with the fiber treatment agent of the invention by methods such as spraying, roll application, brushing or immersion, etc. The add-on will vary with the type of fibrous material involved, but is generally in the range of 0.01 to 10.0 wt % organopolysiloxane based on the fibrous material. The fibrous material is then treated, for example, by standing at room temperature, exposure to a hot air current, or heating.

From the standpoint of the material itself, the fibrous material is exemplified by natural fibers such as hair, wool, silk, flax, cotton, angora, mohair, and asbestos; by regenerated fibers such as rayon and bemberg; by semi-synthetic fibers such as acetate; by synthetic fibers such as polyester, polyamide, polyacrylonitrile, polyvinyl chloride, vinylon, polyethylene, polypropylene, and Spandex ®; and by inorganic fibers such as glass fiber, carbon fiber, and silicon carbide fiber. From the standpoint of form, the fibrous material is exemplified by the staple, filament, tow, top, and yarn. From the standpoint of configuration, the fibrous material is exemplified by knits, weaves, nonwovens, and papers.

The invention will be explained using illustrative examples. In the examples, parts = weight parts, and the viscosity is the value measured at 25° C.

EXAMPLE 1

850 Parts water, 10 parts dodecylbenzenesulfonic acid, and 600 parts cyclic dimethylsiloxane tetramer were placed in a 2 L beaker and stirred to homogeneity. This mixture was passed 4 times through an homogenizer at a pressure of 400 kg/cm$^2$ to produce a crude emulsion.

Separately, 1300 parts water and 180 parts dodecylbenzenesulfonic acid were placed in a 5 L four-neck flask, followed by dissolution and maint enance of a liquid temperature of 85° C. with slow stirring. The crude emulsion was gradually dripped into this aqueous solution of dodecylbenzensulfonic acid over 2 hours. After dropwise addition and cooling, emulsion polymerization was then conducted by maintenance for 2 hours at 48° C. After polymerization, the pH was adjusted to 7.0 using 50 wt % aqueous sodium hydroxide to produce emulsion A.

The average particle size in this emulsion A, as measured using a Quasi-Elastic Light-Scattering Model M2000 from the Malrer Company (USA), was 0.05 micrometers, confirming it to be a microemulsion. This microemulsion was broken with methanol in order to extract the oil, which was determined to be a hydroxyl-group-terminated dimethylpolysiloxane with a viscosity of 60,000 centistokes.

Emulsion A was diluted with water to give a silicone concentration of 2 wt %, and 400 cm$^3$ of this was placed in a rectangular 20 cm × 35 cm × 3 cm stainless steel vat. This vat contained 2 rubber rolls with diameters of 6 cm (nip pressure = 0.5 kg/cm$^2$) which were assembled in a vertical stack, and the lower roll dipped about 0.5 cm into the emulsion. The rolls were then driven for 8 hours at 20 rpm, followed by a visual inspection of the mechanical stability of the microemulsion with respect to rubber roll rotation, and these results are reported in Table 1. Furthermore, 25 cm$^3$ of the emulsion was collected after this treatment with the rubber rolls and was then centrifugally separated at 3,500 rpm. These results are also reported in Table 1.

Emulsion A was also diluted with water to give a silicone concentration of 5 wt %, and 500 cm$^3$ of this was placed in a household juicer mixer and processed for 60 minutes at 4,000 rpm. The condition of the emulsion was inspected visually after this processing, and the results are reported in Table 2. After this processing by the juicer mixer, the emulsion was sprayed on a black, 100 wt % rayon nonwoven fabric using a simple air sprayer, and this was then heated at 150° C. for 3 minutes. The resulting treated fabric was visually evaluated for the presence/absence of oil spots, and the fabric's handle was evaluated by feel. These results are reported in Table 2.

COMPARISON EXAMPLE 1

350 Parts trimethylsilyl-terminated dimethylpolysiloxane having a viscosity of 350 centistokes, 30 parts polyoxyethylene alkyl ether, and 30 parts water were mixed to homogeneity, and then emulsified in a colloid mill. This was dispersed to homogeneity in 590 parts water to afford a mechanically emulsified emulsion having an average particle size of 1.5 micrometers (emulsion B).

Emulsion B was diluted with water to a 2 wt % silicone concentration, and the mechanical stability with regard to rubber rolls was then tested exactly as in Example 1. These results are reported in Table 1.

Emulsion B was also diluted with water to a silicone concentration of 5 wt %, and the mechanical stability with regard to the household juicer mixer was tested exactly as in Example 1. These results are reported in Table 2.

COMPARISON EXAMPLE 2

300 Parts cyclic dimethylsiloxane tetramer, 20 parts dodecylbenzenesulfonic acid and 670 parts water were stirred to homogeneity, and this was then passed 4 times through an homogenizer at a pressure of 400 kg/cm$^2$. The obtained emulsion was then maintained for 2 hours at 85° C. followed by 2 hours at 48° C. to afford an emulsion-polymerized emulsion having an average particle size of 0.3 micrometers (emulsion C).

Emulsion C was diluted with water to a silicone concentration of 2 wt %, and the mechanical stability with regard to rubber rolls was evaluated exactly as in Example 1. These results are reported in Table 1.

Emulsion C was also diluted with water to a silicone concentration of 5 wt %, and the mechanical stability with regard to the household juicer mixer was evaluated exactly as in Example 1. These results are reported in Table 2.

TABLE 1

| | average particle size in the emulsion, in micrometers | adhesion of oil to rubber roll | status of emulsion after centrifugal separation |
|---|---|---|---|
| Example 1 | 0.05 | no oil adhesion | completely homogeneous aqueous solution, no floating oil |
| Comparison Example 1 | 1.5 | oil adheres to the surface of the rubber roll, crawling of the emulsion | sheen observed, indicating floating oil |
| Comparison Example 2 | 0.3 | slight oil adhesion, slight crawling of the emulsion | small amount of floating oil observed |

TABLE 2

| | status of oil adhesion after processing in the juicer mixer | oil spots on the treated fabric | handle of treated fabric |
|---|---|---|---|
| Example 1 | absolutely no adhesion of oil on the blades or glass walls of the juicer mixer | absolutely none | very good softness |
| Comparison | small amount of oil adhesion to blades | small amount of oil spotting | inadequate softness |

TABLE 2-continued

| | status of oil adhesion after processing in the juicer mixer | oil spots on the treated fabric | handle of treated fabric |
|---|---|---|---|
| Example 1 | | | |
| Comparison Example 2 | oil adheres to both blades and glass walls | ca. 0.5 ~ 1 mm oil spots here and there | inadequate softness |

EXAMPLE 2

400 Parts dimethylsiloxane cyclic tetramer, 10 parts hexamethyldisiloxane, 560 parts water, and 30 parts of the ethyleneoxide adduct (45 moles) of octylphenol were mixed to homogeneity, and this was then passed through an homogenizer at 450 kg/cm$^2$ to produce a crude emulsion.

Separately, 130 parts dodecylbenzenesulfonic acid and 870 parts water were placed in a 3 L four-neck flask, followed by dissolution and maintenance at a liquid temperature of 80° C. with slow stirring. The crude emulsion was then gradually dripped into this aqueous solution of dodecylbenzenesulfonic acid over 2 hours. After dropwise addition, the mixture was cooled and then maintained at the same temperature for an additional 3 hours to conduct emulsion polymerization. After polymerization, the pH was adjusted to 7.0 using 10 wt % aqueous sodium hydroxide.

The product was a microemulsion having an average particle size of 0.08 micrometers and a transmittance at 580 nanometers of 91%. The microemulsion was broken with methanol, and the extracted oil was confirmed to be trimethylsilyl-terminated dimethylpolysiloxane having a viscosity oof 280 centistokes.

This emulsion was diluted with water to a silicone concentration of 1 wt %, and this dilution was then evaluated for the following as in Example 1: mechanical stability with regard to the juicer mixer, oil spotting on fabric treated with emulsion which had been processed in the juicer mixer, and handle of the treated fabric. It was found that the mechanical stability with regard to the juicer mixer was excellent (no floating oil; that the fabric treated with the juicer mixer-processed emulsion did not have oil spots; and furthermore that the fabric's handle was good.

EXAMPLE 3

300 Parts dimethylsiloxane cyclic tetramer and 2 parts beta-glycidoxyethyltrimethoxysilane were mixed, and this mixture was then mixed to homogeneity into a solution of 30 parts polyoxyethylene nonylphenol ether (20 moles EO) and 300 parts water. A crude emulsion was obtained by passing this through an homogenizer 2 times at a pressure of 400 kg/cm$^2$.

Separately, 50 parts beef tallow trimethylammonium chloride, 20 parts polyoxyethylene nonylphenol ether (20 moles EO), 3 parts sodium hydroxide powder, and 290 parts water were mixed to homogeneity and then maintained at a liquid temperature of 85° C. with slow stirring. The crude emulsion was then gradually dripped into this mixture over two hours. After addition, emulsion polymerization was conducted by maintenance at the same temperature for another 5 hours. After polymerization, the pH was adjusted to 7.0 using acetic acid. The product was a microemulsion having an average particle size of 0.04 micrometers. This emulsion was broken with methanol, and the extracted oil had a viscosity of approximately 800,000 centistokes.

Three parts of this emulsion was then mixed to homogeneity with 10 parts of a 50 wt % aqueous solution of glyoxal resin, 1 part amine catalyst, and 86 parts water. After standing for 24 hours, the blending stability with regard to amine catalyst and glyoxal resin was evaluated visually. No floating resin or oil was observed, and the stability was thus good. A man's shirt fabric (65 wt % polyester/35 wt % cotton mixed fabric) was immersed in this for 10 seconds, wrung out between rolls, dried at room temperature, and then heated in an oven at 150° C. for 3 minutes. This treated fabric did not have any oil spots, and the crease resistance, as tested manually, was good, confirming suitability as a finishing agent for shirting.

EXAMPLE 4

400 Parts octamethyltetrasiloxane, 570 parts water, and 30 parts of a 50/50 (weight) mixture of beef tallow trimethylammonium chloride and dicoco dimethylammonium were mixed to homogeneity, and a crude emulsion was obtained by passing this mixture 3 times through an homogenizer at a pressure of 3.5 kg/cm$^2$.

Separately, 130 parts of a 50/50 (weight) mixture of beef tallow trimethylammonium chloride and dicoco dimethylammonium, 870 parts water, and 4 parts sodium hydroxide powder were placed in a 3 L four-neck flask, followed by dissolution and then maintenance at a liquid temperature of 85° C. with slow stirring. The crude emulsion was gradually dripped into this aqueous solution over 2 hours. After addition, emulsion polymerization was conducted by maintenance at the same temperature for an additional 3 hours. After polymerization, the pH was adjusted to 7.0 using glacial acetic acid.

The product was a microemulsion having an average particle size of 0.10 micrometers. This emulsion was broken using methanol, and the extracted oil was determined to be a hydroxyl-terminated dimethylpolysiloxane having a viscosity of 1,200 centistokes.

The microemulsion was diluted with water to a silicone concentration of 2 wt %. This was applied to 100 wt % wool yarn for handknitting (3 wt % silicone add-on), followed by drying at room temperature and then heating at 130° C. for 3 minutes. The treated wool yarn had absolutely no oil spots, a substantially greater smoothness than the untreated yarn (scoured yarn), and an excellent firmness and rebound and so could be converted into a loosely knitted product.

We claim:

1. An improved method of obtaining oil spot free, siloxane treated fibers, the method comprising (I) applying a siloxane to the fibers and, (II) drying the fibers, the improvement comprising using as a siloxane treatment a composition whose major siloxane component is an organopolysiloxane microemulsion whose average particle size after polymerization is equal to or less than 0.15 micrometers and whose viscosity after the emulsion is broken is at least 100 centistokes at 25° C., which siloxane is prepared by emulsion polymerizing cyclic organopolysiloxanes having the following formula

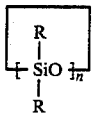

wherein each R is independently selected from monovalent hydrocarbon radicals and n is an integer having a value of 3 to 10.

2. Treated fibers prepared by the methods of claim 1.

3. The method as claimed in claim 1 wherein there is also present before the polymerization, a material selected from the group consisting of (i) hydroxyl-terminated diorganopolysiloxane,
(ii) hydrolyzable group-containing silane,
(iii) hexaorganodisiloxane, and
(iv) sodium hydroxide.

4. The method as claimed in claim 1 wherein there is present before the polymerization octamethyltetrasiloxane, a quaternary ammonium chloride, sodium hydroxide and water.

* * * * *